US006155476A

United States Patent [19]

Fabel

[11] Patent Number: 6,155,476

[45] Date of Patent: Dec. 5, 2000

[54] LAMINATED MAILER BLANK WITH TRANSPARENT WINDOW

[75] Inventor: Warren M. Fabel, Delray Beach, Fla.

[73] Assignee: Laser Substrates, Inc., Boca Raton, Fla.

[21] Appl. No.: 09/132,036

[22] Filed: Aug. 11, 1998

Related U.S. Application Data

[63] Continuation-in-part of application No. 08/240,869, May 10, 1995, abandoned, and a continuation-in-part of application No. 08/349,062, Dec. 1, 1994, Pat. No. 5,954,431, and a continuation-in-part of application No. 08/377,126, Jan. 23, 1995, Pat. No. 5,899,504, and a continuation-in-part of application No. 08/434,416, May 3, 1995, Pat. No. 5,791,553.

[51] Int. Cl.[7] ..... B65D 27/00

[52] U.S. Cl. ..... 229/92.3; 283/74; 283/103

[58] Field of Search ..... 229/92.1, 92.3, 229/71, 92.8; 283/74, 103, 109

[56] References Cited

U.S. PATENT DOCUMENTS

| | | | |
|---|---|---|---|
| 3,370,781 | 2/1968 | Sroge . | |
| 4,371,489 | 2/1983 | McGrail . | |
| 4,936,769 | 6/1990 | Schoenleber . | |
| 4,951,864 | 8/1990 | Dicker . | |
| 5,294,042 | 3/1994 | Giordano . | |
| 5,418,205 | 5/1995 | Mehta et al. . | |
| 5,650,209 | 7/1997 | Ramsburg et al. | 229/71 X |
| 5,667,247 | 9/1997 | Ramsburg et al. | 229/71 X |
| 5,705,243 | 1/1998 | Mehta et al. | 229/92.1 X |
| 5,791,553 | 8/1998 | Fabel | 229/92.1 |
| 5,836,622 | 11/1998 | Fabel | 229/92.8 X |

*Primary Examiner*—Jes F. Pascua
*Attorney, Agent, or Firm*—Ted W. Whitlock

[57] ABSTRACT

A mailer blank, which may be configured for subsequent printing and folding processes, includes a transparent sheet and an attached opaque layer, both of which extend between longitudinal and transverse edges. An aperture is formed within the opaque layer. In a first version, the mailer blank also includes a second opaque layer, having an aperture aligned with the aperture of the first opaque layer, similarly extending between the longitudinal and transverse edges. Both the first and second layers are paper, adhesively attached to opposite sides of the transparent layer. In a second version, the opaque layer is a ultra-violet ink coating. In a third version, a paper layer is attached to one side of the transparent sheet, with a pocket being formed between one of the paper layers and the sheet for use as a return envelope. In a fourth version, a two-ply laminated mailer provides a removable ID card formed in the transparent layer which becomes the inside of the envelope when the mailer is folded along a predetermined fold line and sealed at its edges.

8 Claims, 7 Drawing Sheets

FIGURE 5
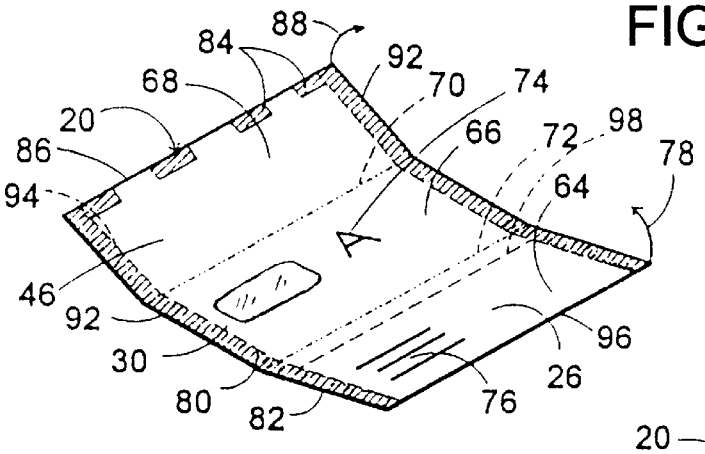
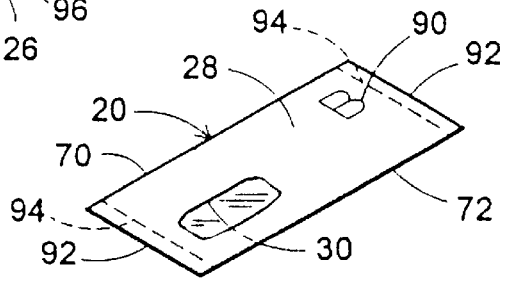
FIGURE 6
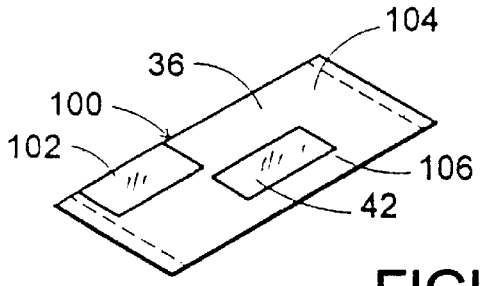
FIGURE 7
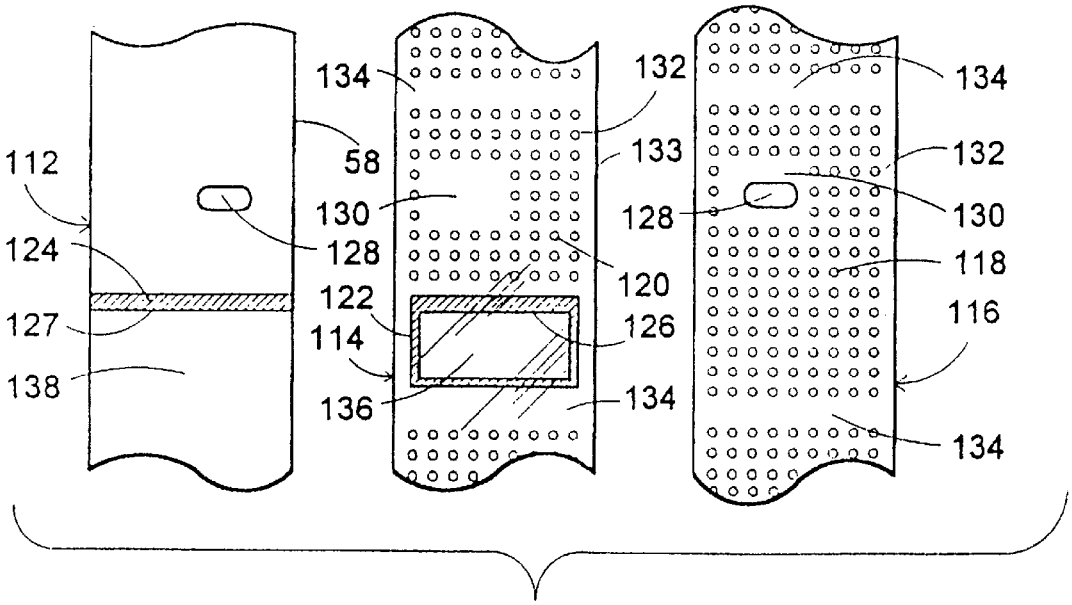
FIGURE 8

LAMINATED MAILER BLANK WITH TRANSPARENT WINDOW

RELATION TO OTHER PATENT APPLICATIONS

This is a continuation-in-part of U.S. patent application Ser. No. 08/240,869, filed May 10, 1995, now abandoned; U.S. patent application Ser. No. 08/349,062; filed Dec. 1, 1994, now U.S. Pat. No. 5,954,431; U.S. patent application Ser. No. 08/377,126, filed Jan. 23, 1995 now U.S. Pat. No. 5,899,504; and U.S. patent application Ser. No. 08/434,416, filed May 3, 1995, now U.S. Pat. No. 5,791,553.

BACKGROUND OF THE INVENTION

1. Field of the Invention

This invention relates to a flat laminated sheet for being folded into a mailer with a transparent window, and more particularly to providing such a sheet in a form which can be fed reliably through printing and folding devices.

2. Description of the Prior Art

A number of different types of mailer blanks are used to provide mailers after suitable printing and folding operations. A typical mailer, after the printing operations are completed, includes at least some variable information, such as the address of the individual to whom the mailer will be sent. The mailer may also have fixed information, which is applied in an identical manner to a large number of mailers.

It is often particularly desirable to print the address to which the mailer is being sent, along with other variable information as needed, on a part of the mailer blank which becomes the inside of an envelope structure after the folding processes are completed. Often, a transparent window is provided on a part of the mailer blank through which a portion of the printed information can be viewed after the printing and folding processes are completed. Such a window is conventionally formed by adhesively attaching a transparent sheet of plastic or cellulose material to extend across an aperture which has been die cut in the sheet of paper forming the mailer blank. By properly aligning the printing, the address information can be read through the transparent window positioned opposite to the address information after folding. In this way, it becomes unnecessary to print variable information on both sides of the mailer blank; rather, all such information is printed on the surface which becomes the inside of the envelope structure, thereby saving a printing step.

For example, when a mailer of the type just described is used to distribute checks, the name and address of the recipient may be visible both as the location to which the mailer is addressed and as the payee of the check. Upon receipt, the envelope is opened and the check portion is separated from the remaining portion of the mailer by tearing along a perforated line. Other variable information, such as the amount of the check and account numbers is printed on the same side of the mailer blank as the check, but is concealed when mailer is folded for mailing.

U.S. Pat. No. 4,951,864 to Dicker describes apparatus a typical prior art mailer blank and the folding and sealing thereof. Dicker's mailer blank includes remoistenable glue strips on the longitudinal sides and one traverse side of the blank, which strips are moistened prior to folding into a mailer envelope. A window aperture shown within the mailer is formed by adhesively attaching a transparent sheet to extend across a rectangular opening in the paper of the mailer. However, the transparent sheet overlaps the opening, being adhesively attached to the paper around the opening, causing the localized increase in thickness.

A particular problem with a conventional mailer blank of the type described above arises. as a result of the additional thickness of the transparent sheet used to form the window. A typical mailer blank is made from 0.004 inches thick paper stock and 0.001 inch thick transparent sheet attached by an adhesive around an aperture in the paper stock. Thus, around the edges of the aperture, where the paper stock and the transparent sheet overlap, the thickness of the mailer blank is increased by 0.001 inch, or 25 percent of the paper thickness. Because of this difference in thickness, the mailer blanks do not lie flat when they are stacked for feeding into the, apparatus used for the printing and folding apparatus. They further do not lie flat when stored as inventory or shipped from the point of manufacture to the end user's facilities. Even if shims are used in packing, the mailer blanks generally have a permanent curl when they are removed from the cartons in which they are shipped and stored.

More recently, it has become common practice for a company such as an insurance company or other organization, to provide an identification card (Id card) to an individual wherein the ID card bears a particular identification number, e.g., a membership or account number, that can be used in storing or retrieving a computerized record relating to that individual. These ID cards are typically manufactured in bulk, pre-printed, and inserted into a mailing envelope.

Moreover, this previous method of providing an ID card increases the number of steps involved in producing individualized mailers. Specifically, the address or other information provided on the mailer must be printed separately from the ID card. The ID card must then be inserted into the mailer, which involves yet another step. This can also result in mismatches between the mailer confirmation and the ID card information that may cause loss of further time and effort in correcting the error.

Mailers for high volume applications are preferably printed and subsequently folded in high speed devices having an input capacity of, for example, 2000 sheets. However, due to the difference in thickness abound the window aperture, a stack of 2000 sheets of mailer blanks manufactured as described above is typically about twelve inches thick around the aperture and about eight inches thick at locations remote from the aperture, such as the edge of the form being fed into the printing and folding devices. Furthermore, these sheets cannot lie flat an any bin holding them in quantities of about 2000 for feeding into a printing or folding device.

The various mechanisms used to feed sheets one at a time through printing and folding devices are very intolerant of curled sheets, particularly if the curl results in the corners of an individual sheet being raised or lowered with respect to the central part of the sheet. Specifically, the curl prevents individual sheets from being properly separated in the mechanisms designed to separate the sheets so that they can be fed one at a time for printing or folding. In addition, the curl causes the corners of the sheets to be caught on various obstructions along the paper feeding path of the printing and folding devices. In this way, failures to feed sheets and various types of paper jams are caused as the equipment is operated.

A further problem is realized by use of separately printed and inserted ID cards. Specifically, a high speed printer/folder device cannot be utilized efficiently with these cards because they will either jam a form feeder or will need to be adhered prior to the mailer being automatically folded.

These problems have become more serious with an increased use of non-impact printers, such as laser printers, to print the variable information on mailers, since such printers require the rapid and reliable feeding of individual sheets of paper into the printing process.

Attempts have been made to eliminate the need for a second transparent sheet by treating a section of the paper form so that the paper becomes transparent in a particular window area. For example, the See Thru Paper™ Window, Form #9644, manufactured by Standard Register, is described in U.S. Pat. No. 5,418,205. However, the transparency of the window area is actually only "translucent", which can pose problems for automated mail reading devices.

What is needed is a mailer blank having an aperture with a transparent window, without the increased local thickness resulting in paper curl when significant numbers of the blanks forms are stacked.

What is also needed is a mailer blank which does not require separate printing and adherence of an identification card so that printing and folding can be efficiently carried out on an automated device.

SUMMARY OF THE INVENTION

In accordance with one aspect of the invention, there is provided a mailer blank having a transparent layer and an opaque layer on one side of said transparent layer. The opaque layer includes an aperture covered by said transparent layer to form a window. Further, the opaque layer and transparent layer are coextensive outward from the aperture to lateral and transverse edges of the mailer.

In one embodiment of the subject invention, the mailer blank comprises a die cut area forming identification card (ID card) blanks which can be efficiently printed and folded in an automated printer/folder or folder/sealer device. Advantageously, the ID cards are preferably formed contiguously in an inner layer of the form and can be easily removed therefrom by separating them from the die cut.

BRIEF DESCRIPTION OF THE DRAWINGS

Preferred embodiments of the subject invention are hereafter described with specific reference being made to the following Figures, in which:

FIG. 5 is an isometric view of a mailer formed from the mailer blank of FIG. 2, shown after-printing;

FIG. 6 is an isometric view of the mailer of FIG. 5, shown after folding and adhesive sealing;

FIG. 7 is an isometric view of a mailer formed from the mailer blank of FIG. 3, shown folding and adhesive sealing;

FIG. 8 is a fragmentary plan view of two paper webs, and of a transparent web, which are laminated together and cut to length to form a mailer blank in accordance with a third version of the present invention;

DETAILED DESCRIPTION

Figure 1:
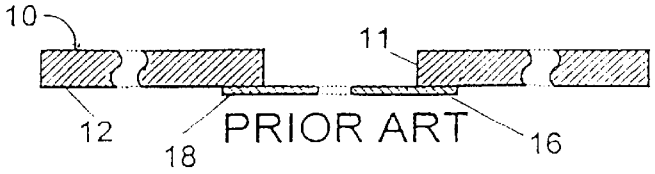
FIG. 1 is a fragmentary, transverse elevational view of a prior art mailer blank formed in accordance with a conventional method, taken through a transparent window provided therein.
Figure 2:
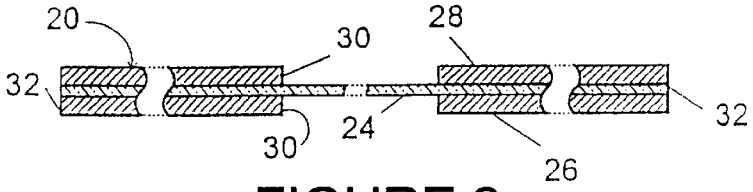
FIG. 2 is a fragmentary, transverse elevational view of a mailer blank formed in accordance with a first version of the present invention, taken through a transparent window provided therein.
Figure 3:
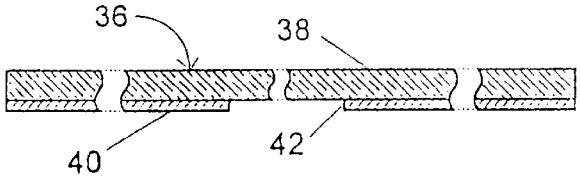
FIG. 3 is a fragmentary, transverse elevational view of a mailer blank formed in accordance with a second version of the present invention, taken through a transparent window provided therein.

Basic differences between a mailer blank constructed according to the prior art and a mailer blank constructed according to the present invention will first be discussed, with references to FIGS. 1–3, each of which is a partial transverse cross-sectional elevation view of a respective mailer blank taken through the window aperture therein. In particular, FIG. 1 illustrates the prior art mailer blank; FIG. 2 illustrates a first embodiment of the present invention; and FIG. 3 illustrates a second embodiment of the present invention.

Referring first to FIG. 1, a typical prior art mailer blank 10 having an aperture window 11 conventionally placed in a sheet 12 of standard paper stock, approximately 0.004 inches in thickness. Aperture 11 is typically formed by die cutting during the manufacture of mailer blank 10. A transparent sheet 16, approximately 0.001 inches in thickness, is attached to cover aperture 11, overlapping in overlap regions 18 extending along each edge of aperture 11. The attachment of transparent sheet 16 is accomplished in overlap regions 18, for example, through the use of an adhesive. Because the thickness of mailer blank 10 in overlap regions 18 includes both the paper thickness, the thickness of the transparent sheet, and the thickness of the adhesive, the total thickness of a stack of 2000 mailers 10 is increased from approximately eight inches to approximately twelve inches between the edges thereof and region 18.

Referring to FIG. 2, a mailer blank 20 fabricated in accordance with a first embodiment of the present invention includes a transparent layer 24, such as a transparent plastic film, laminated between an inner layer 26 of paper stock and an outer layer 28 of paper stock. The designations of "outer" and "inner" are included at this point to indicate the paper layer which will form the outer surface of an envelope, when mailer blank 20 is subsequently folded, from the paper layer which will form the inner surface of the envelope. Each paper layer 26 and 28 includes an aperture 30, which may be formed using conventional die cutting techniques during the manufacture of mailer blank 20. The two apertures 30 are aligned so that, when mailer blank 20 is folded into a pre-defined shape for mailing, visible information can be viewed through apertures 30 and transparent layer 24.

Since transparent layer 24 extends to the edges 32 of mailer blank 20, the thickness of mailer blank 20 is uniform across its entire surface. The uniform thickness is also achieved even if transparent layer 24 slightly overextends or under-extends paper stock layers 26 and 28. It should be noted that the reduction in thickness caused by the elimination of the paper within apertures 30 does not effect the ability of a stack of mailer 20 to be stacked evenly and fed through printing and folding equipment. The thicknesses of both transparent layer 24 and paper layers 26 and 28 are determined to provide suitable stiffness to allow reliable processing through printing and folding operations, as well as to be within the regulations of the U.S. Postal Service for automatic handling of envelopes. Preferably, each of paper layers 26 and 28 has a thickness of about 0.0025 inches, while transparent layer 24 has a thickness of about 0.001 inches.

Alternatively, one of paper layer 26 or 28 may be eliminated in FIG. 2, in which case the, thickness of the remaining paper layer should be 0.004 inches.

Referring now to FIG. 3, a mailer blank 36, fabricated in as a second embodiment of the present invention, is formed using a transparent layer 38 having a side on which an opaque layer 40 is coated. Opaque layer 40 preferably is a ultra-violet rotary screen ink material having a white or pastel color appearance, and having appropriate chemical and physical properties allowing the application thereto of inks and toners by conventional printing processes. It should be noted that opaque layer 40 may be coated on both sides of transparent layer 38 so that mailer 20 resembles the appearance of conventional paper.

An aperture 42 is formed by leaving an open area in opaque layer 40. Again, the increased thickness caused by the overlap condition of the prior art mailer blank 10 (shown in FIG. 1) does not occur, so large numbers of mailer blanks 36 may be stacked for shipping, storage, and, in hoppers for being fed individually into printing and folding devices. To provide suitable stiffness for use as a mailer, the thickness of transparent layer 38 is preferably increased into the range of 0.003 to 0.005 inches.

Alternately, a mailer blank of the type described with respect to FIG. 2 or 3 may be made using a paper layer 26 laminated to a one side of transparent layer 24 or 38, with the opposite side of transparent 24 or 38 being coated with opaque layer 40. In this case, the thickness of transparent layer 24 or 38 would be 0.001 inches.

Referring to FIGS. 2 and 3, transparent layers 24 and 38 are preferably composed of materials capable of passing through the thermal fusing station of a typical laser printer with minimal dimensional changes and curling. A suitable material for these applications is polyethylene terephthalate film. The application of opaque coating 40 is facilitated by applying an anti-static or priming layer to the transparent film layers 24 or 38. A suitable process for applying an anti-static layer is described in U.S. Pat. No. 4,371,489 to McGrail. Depending on the adhesive process used to form the laminations of FIG. 2, this type of coating may also be used to prepare transparent layer 24 for lamination. It should further be noted that the thickness of transparent layer 24 may vary between 0.0005 and 0.00125 inches, with 0.001 inches being a preferred thickness for the first embodiment, as described above with respect to FIG. 2; a preferred thickness being between about 0.003–0.005 inches for transparent layer 38 for the second embodiment, as described above with respect to FIG. 3.

One preferred type of material that may be used for transparent layers 24 and 38 is Melinex 1311, one distributor of which is Plastic Suppliers, 1174 Hayes Industrial Drive, Marrietta, Ga. 35062. Melinex 1311 is a clear film with anti-static properties on both surfaces of its web. Its surface resistivity, independent of gauge, is $2\times10^{10}$ ohms/square, which overcomes the static electricity and laser corona based problems which generally prevent stacks of plastic films from being used with laser printers. Moreover, Melinex 1311 film does not suffer from unacceptable shrinkage, when passed through the high heat of the fusing stage of a laser printer. Melinex 1311 polyester film is described in more detail in U.S. Pat. No. 4,371,489 in the name of Patrick T. McGrail and entitled "Production of Antistatic Thermoplastic Films". Additional problems encouraging the use of Melinex 1311 film are discussed in my co-pending patent application Ser. No. 08/394,062, filed Dec. 1, 1994 and entitled "Transparent Security Pocket Compatible With Non-impact Printers". Melinex 1311, or its equivalent without the anti-static coating, may be used as the transparent layer where paper covers substantially both sides of the transparent plastic film, such as shown in FIG. 2.

Figure 4:
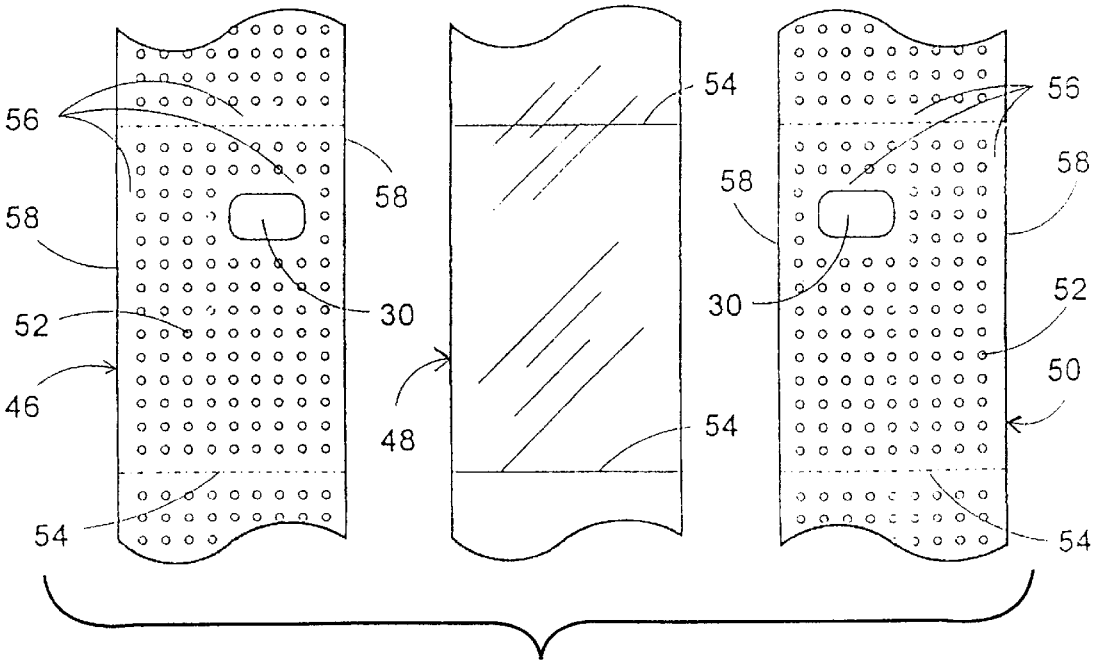
FIG. 4 is a fragmentary plan view of two paper webs and of a transparent web which are laminated together and cut to length to form the mailer blank of FIG. 2.

Referring now to FIG. 4, a plan view is shown of two paper webs 46 and 50 and one transparent web 48. These three webs 46, 48 and 50 are laminated together and cut to length to form mailer blank 20 shown in FIG. 2. More specifically, inner paper web 46 forms inner paper layer 26, transparent web 48 forms transparent layer 24, and an outer paper web 50 forms outer paper layer 28. Preferably, each paper web 46 and 50 is imprinted with a fine array of adhesive dots 52 on surface 54 to be applied against transparent web 48. In order to avoid cluttering, a relatively course array of dots 52 is shown for illustrative purposes in FIG. 4. Dots 52, for example, are formed of a pressure sensitive adhesive applied using either a screen printing process or a flexographic printing process. Applying adhesive dots 52 in this manner minimizes the bulk of the adhesive, while providing a desirable type of flexibility in mailer blank 20 at a cost effective price.

In FIG. 4, paper layers 46 and 50 are oriented to show adhesive dots 52, that is, both paper layers 46 and 50 are transversely displaced from transparent web 48, and inner paper web 46 is shown as being inverted from the orientation it has when laminated to transparent web 48. In the lamination process, outer layer 50 is applied, with pressure exerted between nip rollers (not shown), to a first side of, transparent web 48, and inner layer 46 is applied, also with pressure exerted between nip rollers (not shown) to the side of transparent web 48 opposite the first side. Each paper web 46 and 50 includes a number of apertures 30, which are arranged so that apertures 30 of outer web 46 individually align with the apertures 30 of inner web 50 following the lamination process.

Continuing to refer to FIGS. 2 and 4, the laminated web formed by laminating paper webs 46 and 50 to transparent web 48 is subsequently cut into suitable lengths, each such length to be used as a mailer blank 20. In FIG. 4, the location of the cuts between adjacent mailer blanks is indicated by lines 54. Conventional electronic registration or a pattern pre-printed on the non-adhesive coated surface of one of the paper webs 46 or 50 may be used for determining the location of each of the apertures 30 and cuts 54. Various perforations and/or cuts through one or both paper layers may also be made on the laminated web at appropriate locations prior to making each cut 54 to separate the web into mailer blanks 20. As described hereafter, these additional perforations and cuts facilitate the subsequent folding and/or use of each mailer blank 20 into an envelope configuration.

Adhesive dots 52 are preferably arranged in a pattern which provides gaps 56, in which adhesive dots 52 are not applied to paper webs 46 and 50. Gaps 56, for example, are placed along the outer edges 58 of the webs, around apertures 30, and along the locations, indicated by lines 54, where the web will be cut into suitable lengths. Gaps 56 prevent the outward flow of adhesive during the subsequent movement of mailer blank 20 through the heat and pressure fusing station of a laser printer which may subsequently be used to print information on mailer blank 20. A gap width from an adjacent edge of 0.020 to 0.125 inches is preferably used for this purpose, depending on the type and quantity of adhesive used in the lamination process. Without gaps 56, adhesive material could be squeezed out of mailer blanks 20 and accumulate in the fusing station of the printer, resulting in the contamination of the printer. A similar gap for the adhesive dots 52 may also be placed around apertures 30.

Referring now to FIG. 5, an isometric view of a mailer formed from mailer blank 20 is shown in a state following the printing and lamination. The reference numerals used in FIGS. 2 and 4 are also used to indicate like features in FIG. 5. In FIG. 5, mailer 20 includes a lower portion 64, a central portion 66, and an upper portion 68. Central portion 66 may be separated from upper portion 68 by an upper fold line 70, and from lower portion 64 by a lower fold line 72. Fold lines 70 and 72 may be perforated or compressed lines formed during the manufacture of mailer blank 20 after the lamination, as shown and described with respect to FIG. 4, or they may merely be the fold lines resulting from the operation of folding devices into which mailer blank 20 is to be subsequently fed.

Both fixed information, which does not vary from one mailer 20 to another during the preparation of a batch of mailers 20, and variable information, which does vary from one mailer 20 to another, are printed on inner paper layer 26 formed as a part of web 46. The variable information includes at least a name and address, which is to be printed-in area 76 and oriented to be visible through aperture 30 when mailer 20 is folded along lower fold line 72 in the direction indicated by arrow 78. Thus, the printed information should be oriented as indicated by the orientation of the letter "A" 74 in FIG. 5. Variable information is expected to be printed using a simplex non-impact printer, such as a laser printer or an ink jet printer, whereas fixed information can be printed using the same non-impact printer, or it may be pre-printed during or after the manufacture of mailer 20 by normal commercial printing processes. Where the fixed and variable information are printed together, they may be printed during a single pass through the non-impact printer, as all necessary information need only be printed on inner paper layer 26.

Where fixed information is pre-printed, colors and patterns not readily available using a non-color, non-impact printer may be included on form 20 and printing can occur on both inner layer 26 and outer layer 28. For example, the pre-printing may even occur on one or both of paper webs 46 and 50 (on the side opposite to the side on which adhesive dots 52 are placed) prior to applying adhesive dots 52 and laminating webs 46 and 50 to transparent web 48, as seen in FIG. 4.

Mailer 20 also includes an adhesive strip 80 extending adjacent to each lateral edge 82 and a segmented adhesive strip 84 extending adjacent an upper transverse edge 86. In FIG. 5, adhesive strips 80 and 84 are indicated by cross-hatching. While strip 80 is shown as continuous, it is understood that it also can be broken into non-continuous segments or otherwise patterned to control the amount of adhesive applied. Adhesive strips 80 and 84 are preferably composed of a material which can pass through the various processing stations of a non-impact printer, including the fusing station, without adverse effects. For example, the material forming adhesive strips 80 and 84 may be a microencapsulated adhesive or a remoistenable adhesive. In addition, during the manufacture of mailer 20, suitable longitudinal perforated lines 94 may be formed along the inner boundary of adhesive strip 80, in order to permit mailer 20 to be opened by the recipient.

Mailer 20 is prepared for mailing by folding first along lower fold line 72, in the direction of arrow 78, and then along upper fold line 70, in the direction of arrow 88. Pressure, or a combination of pressure and moisture, is applied to the adhesive strips 80 and 84 to seal mailer 20 in its folded condition, as seen in FIG. 6. A number of commercially available devices, well known in the art of producing mailers for distribution, may be used to facilitate both the folding operation and the activation of adhesive strips 80 and 84 through pressure or through a combination of moisture and pressure. U.S. Pat. No. 4,951,864 to Dicker describes both an adhesive system and a folding and sealing device which can be used for this purpose.

Referring now additionally to FIG. 6, there is shown an isometric view of mailer blank 20 after the folding and adhesive sealing thereof. Fixed information is imprinted on outer paper layer 28, oriented as indicated by the letter "B" 90, to provide, for example, a return address, bulk mail permit information, and opening information. Alternatively, a second window may be included in mailer blank 20 for showing a return address printed on inner paper layer 26.

When mailer 20 is received, it is opened by tearing away ends 92, which have been affixed together through the use of longitudinally extending adhesive strips 80. Separable perforated lines 94 provided during the manufacture of mailer blank 20 facilitate opening. Next, the transversely extending adhesive strip 84 is pulled away from the portion of outer paper layer 28 to which it is attached. Mailer 20 is then opened by unfolding outward along upper fold line 70, in the direction opposite to arrow 88, and by folding outward along lower fold line 72, in the direction opposite to arrow 78.

Mailer 20 may include a portion 96 which is separable from the remainder of mailer 20 along a perforated tear line 98, which also is formed during the manufacture of mailer blank 20. For example, this separable portion 96 may be a check having the name and address of the payee printed in address field 76.

Referring again to FIG. 3, a mailer blank 36, composed of a thicker transparent plastic film layer 38 having an opaque coating 40, may be perforated and folded as described with respect to FIGS. 5 and 6, resulting in a finished appearance as shown in FIG. 7. A number of printing processes, including the electro-photographic processes of laser printers, may be used to apply printed images to transparent plastic surfaces. Primer coats of various types, or the anti-static coating process described in U.S. Pat. No. 4,371,489 may be used to improve various aspects of this printing process. Alternately, opaque coating 40 may be applied to both sides of transparent layer 38, with apertures aligned in each of the opaque coatings 40, generally as shown in FIG. 2.

Referring now to FIG. 7, there is shown a perspective view of a mailer 100 formed from mailer blank 36 (as shown in FIG. 3), having opaque coating 40 on the inner surface of the envelope and a pair of windows 42 and 102. Specifically, window 102 is provided to facilitate printing. the return address on the inner side of mailer 100 together with the addressee's address, which is seen through window 42, as previously explained. Where the transparent plastic film is a transparent polyester film, such as Melinex 1311, fixed information, such as bulk permit information, can be preprinted on the outer surface 28 thereof.

Figure 9:
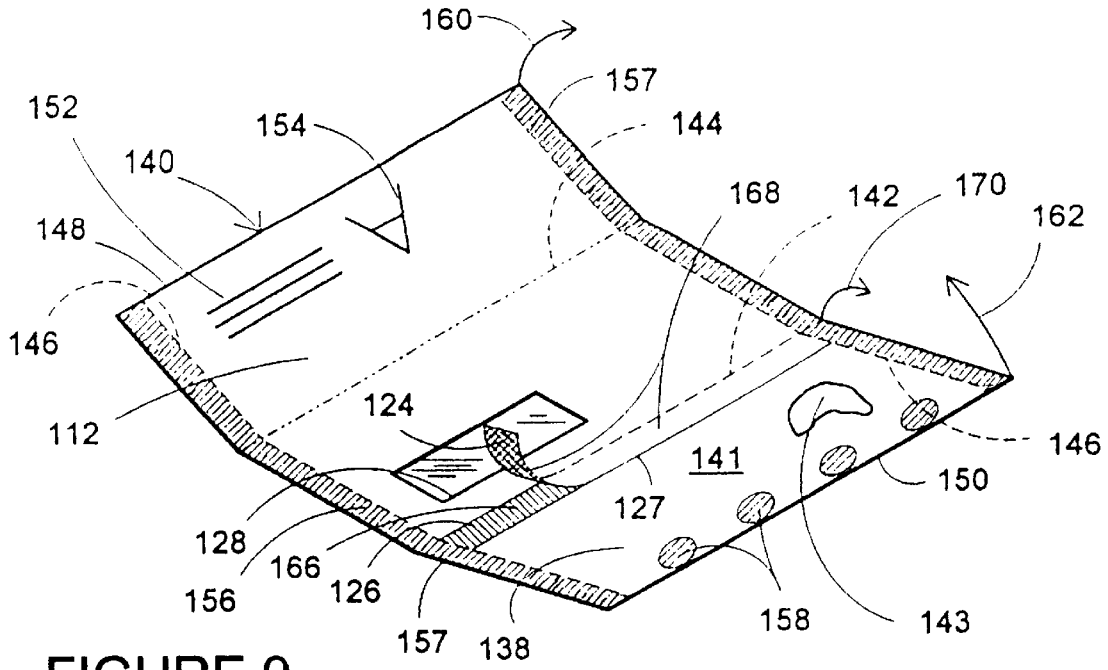
FIG. 9 is an isometric view of a mailer formed from the webs of FIG. 8, shown after printing.

Referring now to FIGS. 8 and 9, there is shown a third embodiment of the present invention, in which an integral envelope 141 is included with a mailer blank 140. Mailer blank 140 provides integral second envelope 141, which can be used by the recipient of mailer 140 to return a document to the original sender of mailer 140. A typical application for mailer 140 is to send a statement in the expectation that a check will be returned in integral second envelope 141. Generally, FIG. 8 shows a fragmentary plan view of two paper webs 112 and 116 and a transparent web 114, which are laminated together and cut to length to form mailer blank 140; and FIG. 9 shows an isometric view of mailer blank 140, formed from webs 112, 114 and 116, in a condition after manufacture and printing and before folding and adhesive fastening.

Referring specifically to FIG. 8, inner paper web 112 is laminated to an upper surface of transparent web 114, and outer paper web 116 is laminated to a lower surface of transparent web 114. Inner paper web 112 subsequently forms an inner surface of mailer blank 140, while outer paper web 116 subsequently forms an outer surface of mailer blank 140. On the surface of outer paper web 116, adjacent to transparent web 114, is a repeating array pattern of adhesive dots 118. As in FIG. 4, a relatively course array is shown for illustrative purposes. Transparent web 114 similarly has a repeating array pattern of adhesive dots 120, together with a hollow rectangular pattern 122, around which adhesive 126 has been applied in a continuous or more dense manner. Inner paper web 112 has a strip of release agent 124 coated thereon in a position to prevent its permanent adhesion to transverse adhesive strip 126. Adjacent to one edge of release agent 124 on inner paper web 112 is a slit tear line 127, which is formed after the lamination of webs 112, 114 and 116. To show the pattern of a release agent 124 in FIG. 8, inner paper web 112 is inverted from the orientation it must assume when it is laminated to transparent web 114.

In addition, apertures 128 are cut in each of paper webs 112 and 116 similar to apertures 30 in FIG. 4. Further, various clear areas 130, 132, 134, Where no adhesive dots 120 are present are placed on webs 114 and 116. More specifically, clear area 130 is placed to be in alignment with apertures 128, clear area 132 is placed along the longitudinal edges 133 of webs 114 and 116, clear area 134 is placed where transverse cuts will subsequently be placed to separate individual forms to be made from laminated webs 112, 114 and 116.

In the process of laminating webs 112, 114, and 116, apertures 128 in paper webs 112 and 116 are aligned with one another and with clear area 130 in transparent web 114. At the same time, release agent 124 is aligned with transverse adhesive strip 126. Paper web 112 is generally attached to transparent web 114, through the array of adhesive dots 120, except in clear areas 130, 132 and 134 and in rectangular area 136 surrounded by hollow rectangular adhesive pattern 122. Paper web 116 is generally attached to transparent, web 114, except for similarly clear areas 130, 132, and 134. As previously described with to FIG. 4, keeping adhesive dots 120 away from edges 133 of mailer blank 140 prevents the contamination which could otherwise result from the outward squeezing of adhesive 120 as mailer blank 140 passes through the fusing station of a laser printer.

A portion 138 of inner paper web 112 is not laminated directly to transparent web 114 in the area adjacent to clear area 136 and is subsequently used in the formation of integral second envelope 141. Because portion 138 is thus not supported by direct lamination to transparent web 114, the overall thickness of inner paper web 112 is about 0.003 to 0.004 inches, while the thickness of outer paper web 118 is preferably held at about 0.0025 inches.

Referring to FIGS. 8 and 9, after the lamination process, a number of perforations are cut to extend through all three layers 112, 114 and 116. More specifically, a transverse perforated tear line 142, and two longitudinal perforated tear lines 146 are placed on mailer blank 140. In addition, transverse slit tear line 127 is cut through layer 112 only. Optionally, a perforated transverse fold line 144 may be cut, particularly if it is desired that the recipient be able to remove a portion of mailer 140 and return it in envelope 141. The laminated weld is then cut to length, forming an upper transverse edge 148 and a lower transverse edge 150. Variable data is printed in an address field 152, being oriented as indicated by the letter "A" 154. Fixed data, and additional variable data, is printed in other areas as desired. As previously described with respect to FIG. 5, an adhesive layer 156 is coated along each longitudinal edge 157, and a series of adhesive dots 158 is placed along lower transverse edge 150.

The process of using mailer 140 begins with folding mailer 140 along fold line 144 in the direction of arrow 160, so that address field 152 becomes visible through aperture 128. Next, mailer 140 is folded, along perforated line 142, in the direction of arrow 162. Adhesive coatings 156 and 158 hold mailer 140 in its folded shape. As previously described with respect to FIG. 5, a number of well known, commercially available document folding devices can be used to assist in the folding and gluing of mailer 140.

After receipt, the recipient opens mailer 140 by separating it along longitudinal tear lines 146 and by prying transverse adhesive dots 158 away from their attachment to outer layer 116 near fold line 144. At this point, mailer 140 appears as seen in FIG. 9, but without the side strips below adhesive layer 156 and further without adhesive dots 158. Next, mailer 140 is separated along tear line 127, thereby exposing the interior pocket 143 of envelope 141 formed between inner paper layer 112 and transparent layer 114. In FIG. 9, inner paper layer 112 is shown as partly cut away to show the interior pocket 143. The limits of pocket 143 are defined by adhesive pattern 126, as inner paper layer 112 in lower portion 138 is not directly attached to the adjacent clear portion 136 of transparent layer 114. Envelope 141 may be used to return an item, such as a check and/or the portion of mailer 140 between perforated line 144 and edge 148, to the organization originally sending mailer 140. After envelope 141 is removed from the remainder of mailer 140 along perforated tear line 142, a closure flap 166, having a tear strip 168 thereon, extends between transverse tear lines 142 and 127 and separates pocket 143 from the edge of envelope 141. At this point, the check, or other item to be returned to the sender of mailer 140, is inserted into pocket 143 and tear strip 168 is removed, exposing adhesive 126, as seen in FIG. 9. On the bottom of tear strip 168, release material 124 is also removed, as it is in a weak contact with adhesive 126. Finally, flap 166 is folded over in the direction of arrow 170 and seals envelope 141 for mailing.

Figure 10:
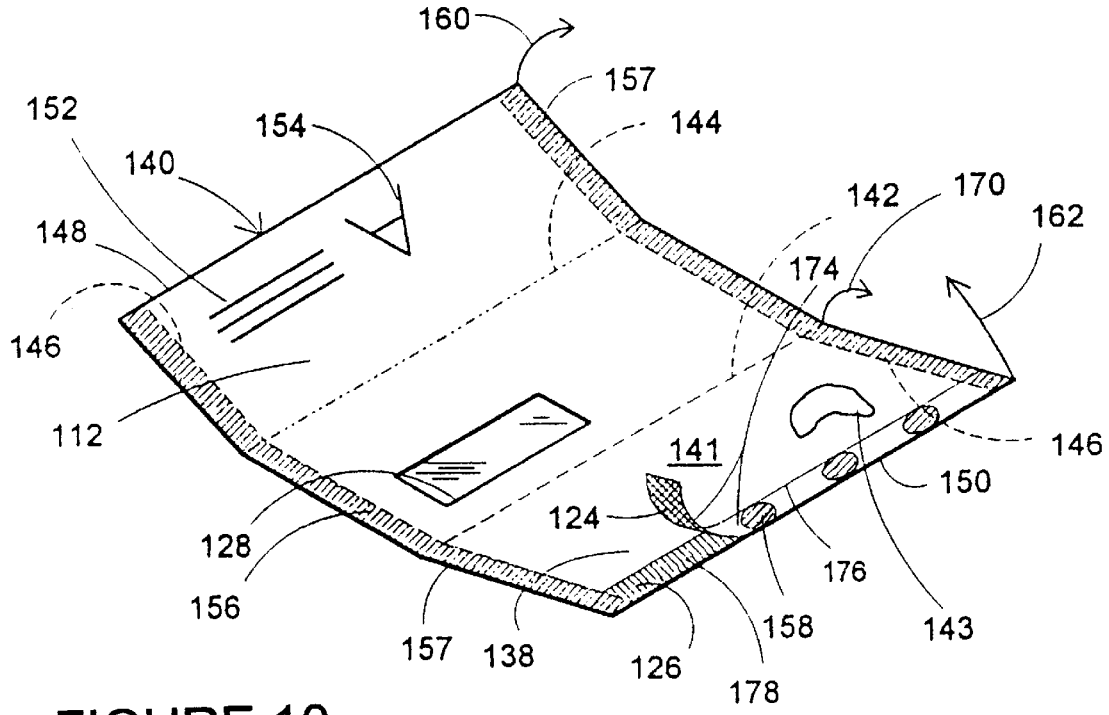
FIG. 10 is an isometric view of an alternate version of the mailer shown in FIG. 9.

Referring now to FIG. 10, an alternate version 172 of mailer blank 140 is shown in which the tear strip 174 and closure flap 178 are placed along the edge 150 instead of along perforated fold line 142. In FIG. 10, like numerical designations are used for similar components shown in FIG. 9. The changes between mailer 140 and mailer 172 are that slit tear line 127 is replaced by slit tear line 176 defining closure flap 178 as being between line 178 and edge 150. Adhesive dots 158 are then placed over tear strip 174 and are removed when tear strip 174 is peeled away. With this change, the adhesive dots 158 do not remain on the return envelope 141 after it is sealed. Further, adhesive 126 in FIG. 8 needs to be rotated 180 degrees and release layer 124 in FIG. 8 needs to be moved downward from the positions shown.

Yet another embodiment of the subject invention includes a laminated form blank for generating identification cards (ID cards) at high speeds on a laser printer in a machine foldable mailer format. These ID cards are issued to individuals by companies, e.g., health or auto insurance companies, or other organizations such as trade organizations, to provide a wallet-sized card bearing information about the individual, including, for example, an identification number.

Figure 11:
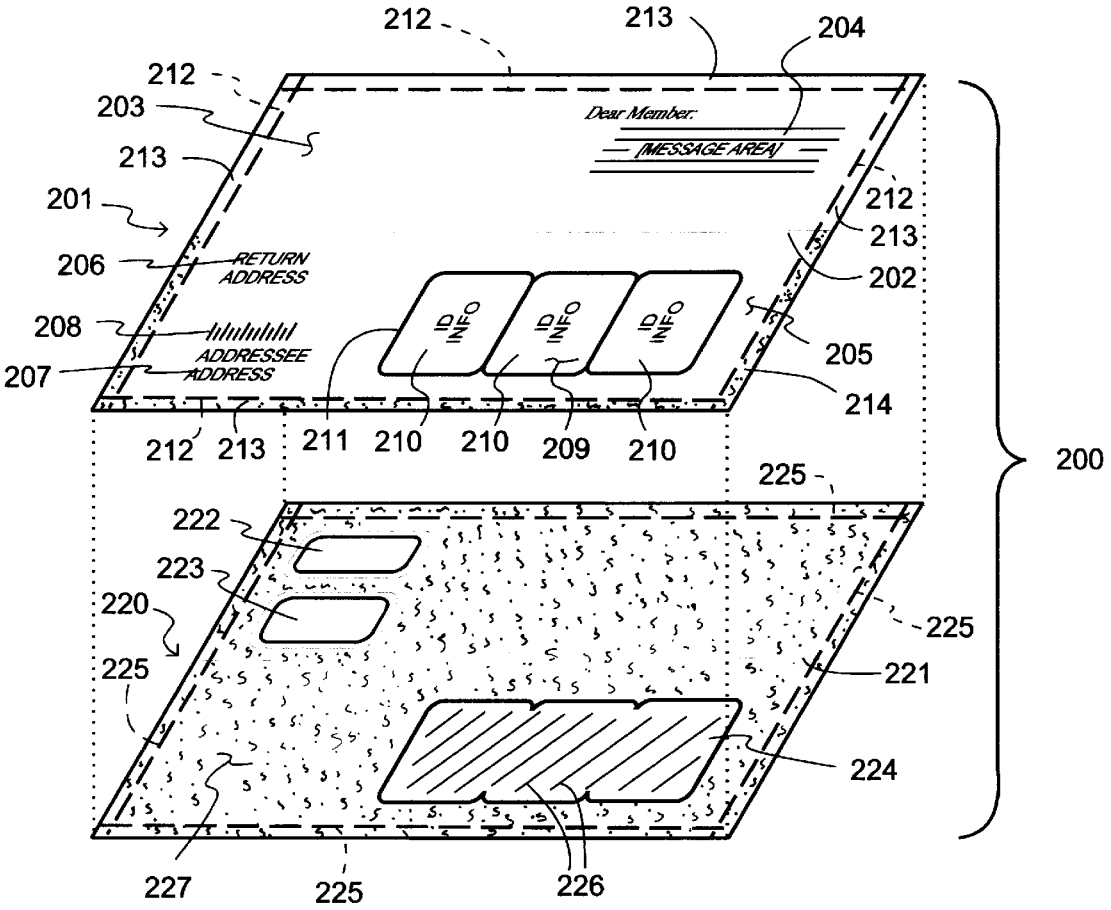
FIG. 11 is an exploded, perspective view of an embodiment for providing an identification card in the folding mailer form according to the subject invention.

One preferred embodiment is illustrated in FIGS. 11–15. Referring to FIG. 11, the subject form 200 is shown in exploded perspective view to illustrate a front or top, substantially transparent sheet 201, and a back or bottom, substantially opaque sheet 220 which are superimposably adjoined to form the two-ply laminated mailing form.

The front sheet 201, as described, is a sheet preferably rectangular and more preferably of standard paper size, provides areas for printing variable information by a non-impact printer. The front sheet is typically divided into two approximately equal halves by a fold line 202 which traverses a central longitudinal axis. The fold line can be formed by a printed line or other indicator, can be a die-cut or score line formed in the front sheet, or can be an imaginary line which is subsequently folded on an automated folding device.

The top half 203 of the front sheet 201 provides a message area 204 for printing information or use or interest to the addressee. The message area 204 is preferably provided toward the top right side of front sheet 201 to allow for proper positioning of other information on the left side of the bottom half 205 of front sheet 201.

On the bottom half 205 of front sheet 201 is provided address areas 206 and 207. Address area 206 is provided for printing a return address of the sender of the mailing form. Address area 207 is provided for printing address information for the addressee. This addressee information can include a bar code 208 useful for automated mail readers used by the United States Postal Service.

On the right side of the bottom half 205 of front sheet 201 is provided an area for printing identification card information. This identification card information area 209 can be printed so that information (shown as "ID INFO" in FIG. 11), e.g., name, date of birth, address, identification number, or the like, can be provided on at least one removable identification card (ID card) 210 to be retained by the addressee. The ID card 210 can be formed by making a die cut or perforation 211 around the entire ID card information area such that an ID card containing the identification information is separable from the rest of the front sheet 201.

A variation of this embodiment shown in FIG. 11 illustrates formation of three ID cards 210 on a single sheet. Die-cut line 211 is made around the perimeter of each individual ID card. For efficiency, die cut line 211 is co-extensive for adjacent ID cards.

A perforation 212 can also be provided along each perimeter edge of front sheet 210 to provide a removable strip 213 when opening the folded mailing form.

An adhesive 214 can be disposed on at least a portion of removable strip 213 such that the top and bottom halves of front sheet 210 are adhered together along its perimeter edge when folded at fold line 202. Preferably, adhesive 214 is disposed along the bottom and two side edges, substantially covering the outer face of corresponding removable strips 213, of either the top half or bottom half of front sheet 201. In this way, the adhesive 214 matches to the corresponding outer edges of the opposing half of front sheet 201 and, along with a folded edge of the form which is created when the form is folded, provides a completely enclosed form whereas the front sheet 201 forms the inner portion of a mailer according to the subject invention.

The adhesive 214 used on the front face of the removable strips of front sheet 201 can be microencapsulated adhesive or remoistenable adhesive, depending on the folder/sealer device used for finishing. Microencapsulated adhesive must be of sufficient size to provide adequate wetting of the sealing edge, and must have sufficient coating so that the microencapsulates are not damaged when processed through a printer feeder. The coating must also be capable of withstanding heat of a laser printer so that premature adherence does not occur prior to folding and sealing of the mailer.

Figure 11A:
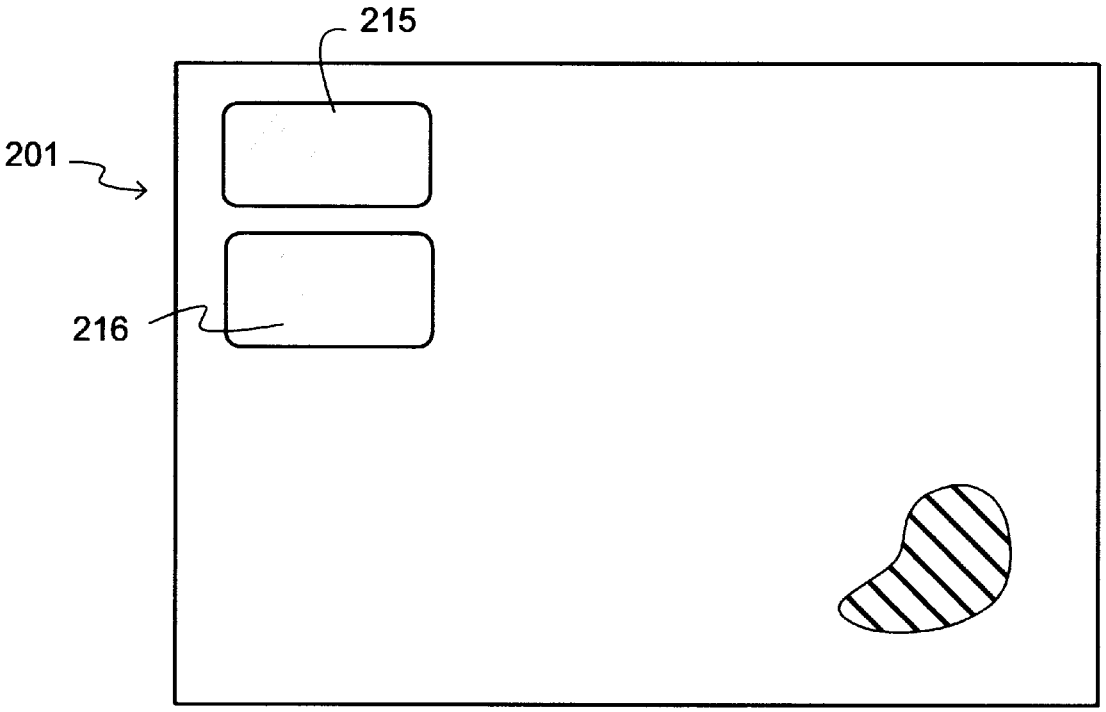
FIG. 11A shows a front or inner face of a front sheet for the embodiment of FIG. 11, having a substantially opaque coating patternly disposed thereon, illustrating a transparent window area.

The front sheet 201 can comprise a plastic or polymeric material, e.g., Melinex 311 which is commercially available. Typically, the front sheet has a thickness of between about 0.003 and 0.005 inches. The front sheet can be transparent or can be printed on one face with an opaque or contrasting color for enhancing legibility of certain variable information printed thereon. However, at least one area on the front sheet is not printed with an opaque or contrasting color so that it remains transparent to provide a window for viewing address information when the form is in its folded configuration. A preferred embodiment is shown in FIG. 11A wherein front sheet 201 (shown prior to the formation of die-cuts, perforations, or printing) is provided with two transparent areas 215 and 216 for viewing address information therethrough. Most preferably, transparent window area 215 permits viewing of the return address information, and transparent window area 216 permits viewing of the addressee information, printed on the bottom left half of the front sheet.

In one alternative variation of this embodiment, the inner face of top sheet 201 is provided with a magnetic identification strip positioned on the back of the card area to provide a conventional credit card identifier useful in accessing an automatic teller machine (ATM) or other device capable of reading such magnetic strips. Further, the inner face of ID card area 210 can be provided with an adhesive release material, as is known in the art, to facilitate removal of an ID card from its backing sheet without any residue adhesive on the card.

The back, or bottom, sheet 220 is configured to substantially conform to the areas or sections provided on the front sheet. Specifically, the back sheet 220 typically comprises a standard, e.g., 8½×11 inches, size sheet of approximately equal dimension to the front sheet. One example of this embodiment is shown in FIG. 11, wherein the back sheet is divided along its central, longitudinal axis to provide a fold line 221, conforming to the position of fold line 202 provided in front sheet 201 when the sheets are superimposed.

The back sheet 220 can be non-contiguous, having at least one cut-out area provided therein to form a window so that address information can be seen therethrough when the form is in a folded configuration. FIG. 11 illustrates one embodiment showing two cut-out areas 222 and 223 corresponding in position to the transparent window areas 215 and 216 in FIG. 11A. Other variations of positioning and numbers of cutout areas would be readily understood according to need and in light of the description provided herein. Typically, however, this cut-out area is provided in the left side of the upper half of the back sheet for forming a conventionally positioned envelope when folded.

On the lower half of back sheet 220 an ID card backing area 224 is formed to provide a support web or backing sheet for the ID card or cards formed by die-cuts 211 in front sheet 201.

A perforation 225 can be formed around each perimeter edge of the back sheet, substantially conforming to the superimposed position of each perforation 212 formed around the perimeter of front sheet 201. Each perforation 225 forms a removable strip 226 which can be removed upon receipt of the mailer for opening the envelope.

Adhesive 227 can be coated or otherwise disposed on the inner face of back sheet 220 so that the inner face of back sheet 220 is substantially covered with said adhesive except for window areas 222 and 223, and ID card backing area 224. In addition, an adhesive-free area, typically about 1/16 inches wide, can be provided along the perimeter edge of the back sheet 220, as well as a perimeter edge of window areas 222 and 223 and ID card backing area 224 to prevent oozing of adhesive from the edges of form 200, into window areas 222 and 223, or onto ID card backing area 224 when the form is subjected to heat while being printed on a laser printer.

In the ID card backing area 224, adhesive 226 can be provided in a striated pattern so that the ID card can be easily removed therefrom. As described, an adhesive release material can also be disposed between the ID card and ID card backing to further facilitate release of the card from the backing.

The back sheet 220 is formed from standard paper stock and is preferably between about 0.001 and about 0.0025 inches thick. What is important is that the total thickness of both the front and back sheet does not exceed that which will efficiently and easily feed through a typical non-impact printer feeder for high speed and high volume printing, or does not exceed U.S. Postal Service requirements when folded.

Figure 12:
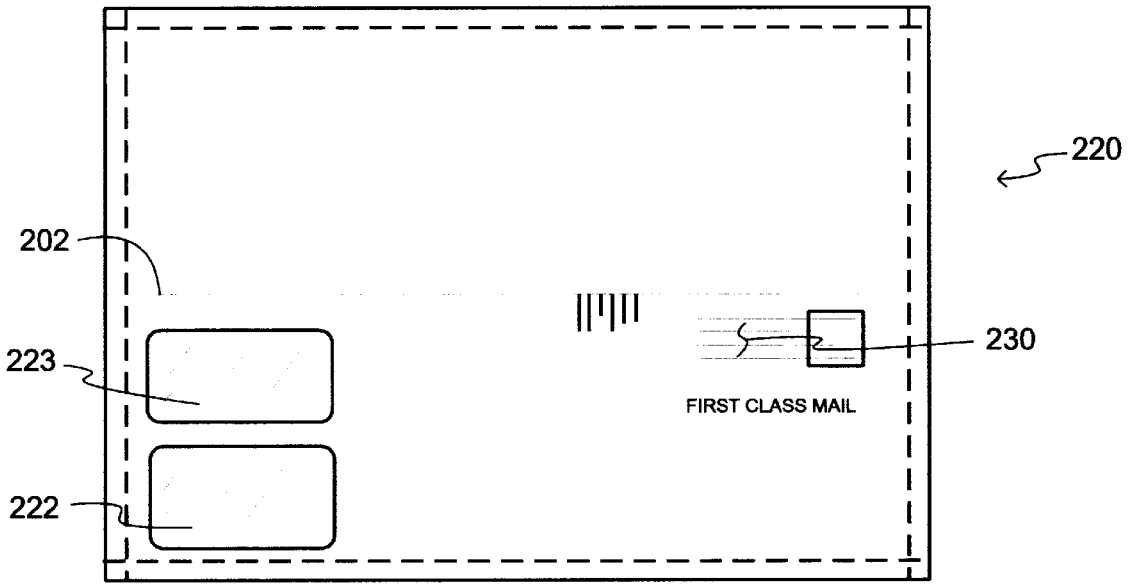
FIG. 12 shows a back face of the back sheet of the embodiment shown in FIG. 11, illustrating placement of window area cut-outs and positioning of printed mailing indicia.
Figure 13:
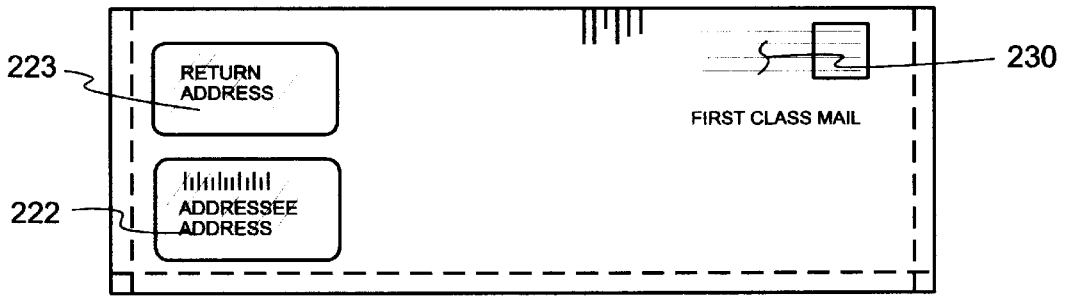
FIG. 13 illustrates the embodiment of FIGS. 11 and 12 in folded configuration.

The back face of back sheet 220 can be pre-printed with mailing indicia 230 in a position to provide standard envelope positioning of the indicia. Typically, as shown in FIG. 12, mailing indicia is printed on the same section half of the back sheet, i.e., in relation to fold line 202, as the cut-out areas 222 and 223. This advantageously provides for forming, in a single folding step, an envelope having address information which is visible through transparent windows 222 or 223, and mailing indicia in proper position in accordance with United States Postal Service standards. See FIG. 13. Instructions for use can also be provided on the back face of back sheet 220. For example, instructions for tearing off the removable strips can be provided for opening the sealed envelope.

In the manufacture of this embodiment of the subject invention, front sheet 201 and back sheet 220 can be pre-printed with any information which is not variable or which is not necessary to be printed by a non-impact printer. For example, instructions for use, mailing indicia, certain invariable message information, or the like can be pre-printed. Cut out areas in back sheet 220 can also be made. Adhesive is thus patternly disposed on the inner face of back sheet 220. The adhesive can be coated in certain areas and striated in certain other areas, for example, in the ID card backing area.

Adhesive can also be patternly disposed on the outer face (which becomes the inner portion of the form in folded configuration) of front sheet 201, particularly along removable strips 213 for sealing the envelope.

Front sheet 201 and back sheet 220 are then superimposably adhered together to form a two-ply mailing form blank. The two-ply mailing form blank 200 can then be printed with variable information, e.g., addressee information, certain message information, or the like, by a non-impact printer, preferably a laser printer.

The printed two-ply mailing form can then be processed through an automated folder/sealer to fold the two-ply form at a predetermined fold line, e.g., fold line 202, and sealed by activating adhesive disposed on the front face of the removable strip.

Figure 14:
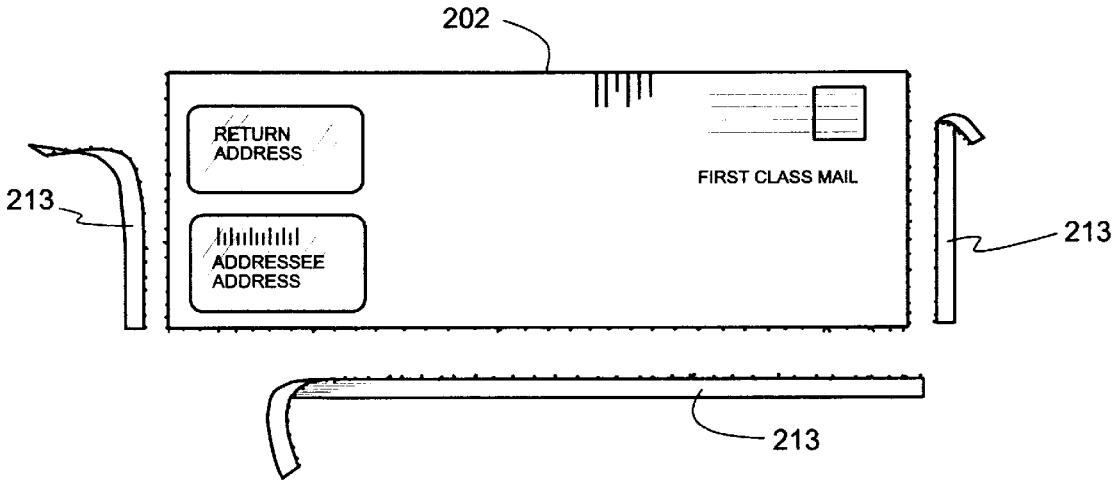
FIG. 14 shows separation of removable strips from the remainder of the ID card mailing form for opening the folding mailer document according to the subject invention.
Figure 15:
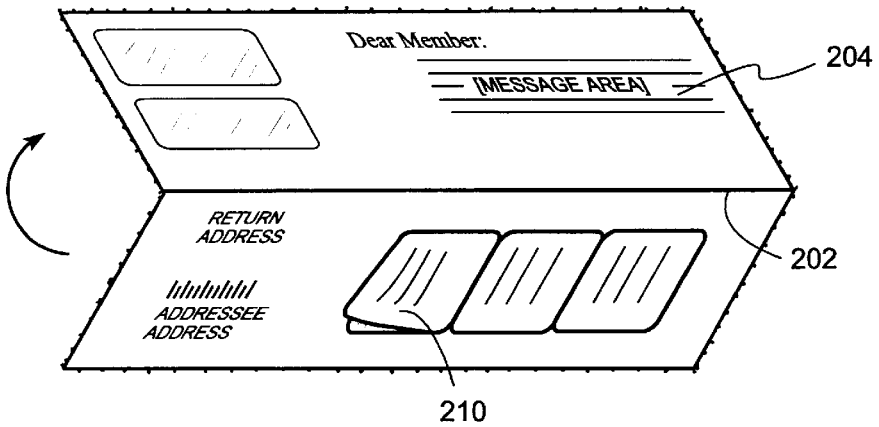
FIG. 15 shows unfolding of the mailer form according to the subject invention for reading a message and removing an identification card formed in the inner sheet of the mailer form.

FIG. 14 illustrates the procedure whereby the mailer of the subject invention can be opened upon its receipt by the addressee. Specifically, removable strips 213 are separated from the folded, sealed envelope or mailer, allowing the mailer to be hingeably opened along fold line 202 to expose the inner face of the mailer. See FIG. 15. The mailer conveniently opens to reveal the message area 204 and removable ID card 210, which can be easily removed and retained by the addressee or other appropriate receiver.

While the above discussion with respect to FIGS. 4 and 8, has described mailer blanks 20 and 140 formed by cutting webs made by laminating paper and transparent layers, which are subsequently cut into suitable lengths, it is understood that similar results, within the scope of the present invention, can be obtained by laminating individual sheets, already cut to the length of mailer blanks 20 and 140, of paper and transparent layers. Similarly, the mailer blanks with respect to FIGS. 11–15 have been described as pre-cut forms, but could alternatively be formed by laminating a plastic and paper web, and then cutting to length. Further, while the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A two-ply mailer blank comprising:

a transparent front sheet; and an opaque back sheet superimposably adhered to said transparent sheet, said opaque sheet comprising a cut-out area covered by said transparent sheet to form a window;

said transparent sheet further comprising a die-cut forming at least one single-ply removable identification card.

2. The mailer blank of claim 1, wherein said opaque sheet is a paper material adhesively attached to said transparent sheet and said transparent sheet is a plastic material which is capable of receiving permanent print by a non-impact printer and is shrink resistant, at temperatures used to fuse toner to paper in a laser printer.

3. The mailer of claim 2, further including at least one transverse fold line to facilitate folding of the mailer into a closed envelope containing said removable identification card.

4. The mailer blank of claim 1, wherein said opaque layer is a paper material attached to said transparent layer by means of an adhesive patternly disposed between said opaque sheet and said transparent sheet when said opaque layer is attached to said transparent layer.

5. The mailer blank of claim 4, wherein said adhesive is striatedly disposed on the back sheet in an area superimposed by the removable identification card.

6. The mailer blank of claim 1, further including a perforated tear line extending along each edge of said mailer blank forming removable strips separable from the remaining portion of said mailer for opening a folded and sealed mailer.

7. The mailer blank of claim 1, wherein the transparent sheet is coated with a separate opaque material except in a window area.

8. The mailer blank of claim 1, wherein said transparent sheet has an adhesive release material disposed on an inner face within die-cut area forming the identification card.

* * * * *